United States Patent [19]

Malone et al.

[11] Patent Number: 4,780,109

[45] Date of Patent: Oct. 25, 1988

[54] COAL WATER SUSPENSIONS INVOLVING CARBON BLACK

[75] Inventors: Donald P. Malone, Grayson, Ky.; David G. Thompson, Ballwin, Mo.

[73] Assignee: Ashland Oil, Inc., Ashland, Ky.

[21] Appl. No.: 946,743

[22] Filed: Dec. 24, 1986

[51] Int. Cl.[4] ..... C10L 1/32

[52] U.S. Cl. ..... 44/51; 252/311.5

[58] Field of Search ..... 44/51; 252/311.5; 423/445, 449

[56] References Cited

U.S. PATENT DOCUMENTS

| | | | |
|---|---|---|---|
| 2,754,267 | 7/1956 | Bondi | 44/51 |
| 3,620,698 | 11/1971 | Schlinger et al. | 44/51 |
| 3,764,547 | 10/1973 | Schlinger et al. | 44/51 |
| 4,090,853 | 5/1978 | Clayfield | 44/51 |
| 4,104,035 | 8/1978 | Cole et al. | 44/51 |
| 4,165,969 | 8/1979 | Hughes et al. | 44/51 |
| 4,305,729 | 12/1981 | Stearns | 44/51 |
| 4,306,881 | 12/1981 | Stearns | 44/51 |
| 4,358,292 | 11/1982 | Battista | 44/51 |
| 4,441,887 | 4/1984 | Funk | 44/51 |

*Primary Examiner*—William R. Dixon, Jr.
*Assistant Examiner*—Margaret B. Medley
*Attorney, Agent, or Firm*—Richard C. Willson, Jr.; Stanley M. Welsh; C. William Crady

[57] ABSTRACT

Disclosed is a composition and method from making coal water slurries containing carbon black. A composition disclosed comprises: 65 to 85% by weight coal particulates; 0.2 to 2% by weight, based on the total weight of dry coal, of carbon black, and optionally 0.2 to 2% by weight, based on the total weight of the dry coal, of a dispersant.

13 Claims, No Drawings

COAL WATER SUSPENSIONS INVOLVING CARBON BLACK

BACKGROUND OF THE INVENTION

Prior Art

This invention relates to methods and compositions for stable slurries containing carbonaceous solid material (such as coal or coke), a carrier liquid (such as water or oil), and optionally, a dispersing agent. More particularly this invention relates to coal water slurries in which carbon black is utilized.

Attempts to use coal as a fuel in place of petroleum-based fuels such as bunker fuel oils and the like, has tended to focus upon dispersions of particulate coals. As a particulate coal dispersion, the material can be burned in typical furnaces and can be transported as if it were a liquid petroleum fuel. The requirements for such transport clearly involve non-settling under conditions of preparation, pumping through pipes, storage in tanks and ability to be supplied into a furnace through atomizing nozzle burners. Conditions of use impose constraints on particulate size requirements. Pumpability suggests that viscosity must not be so great as to make it impractical or impossible to transport the dispersion through a pipe or conduit.

In U.S. Pat. No. 4,090,853 (1978) of D. J. Clayfield et. al. entitled "Coal Oil Product and Method" assigned to Shell Oil Company, a novel coal and liquid hydrocarbon fuel product and method for making is disclosed. Coal of grain size no greater than 6 millimeters is mixed with water and a fuel oil, and then ground until the particles of coal are no greater than 500 microns in size. A wide range of fuel oils from about 200 seconds to 6,000 Redwood 1 may be used and both normal residues and cracked residues may also be included. Water and coal must be mixed before the addition of the oil in order that the desired form of the product may be obtained, i.e. a flocculated structure in oil of coal particles in which water preferentially wets part of the surface of each coal particle and links it to other coal particles.

In U.S. Pat. No. 4,358,292 (1982) of O. A. Battista entitled "Stabilized Hybrid Fuel Slurry", a method of preparing new compositions stabilized by suspensoids of hybrid fuel oils is disclosed. For example, a stabilized fuel slurry may include 30% to 70% liquid fuel oil, 25% to 65% solid fuel particles with sizes up to about ⅛ inch, from 1% to 10% water and from 0.5% to 10% insoluble suspending agents having submicron colloidal particle sizes such as carbon black/graphite and microcrystals isolated from linear organic polymers. High speed agitation is used to make an intimate mixture of these materials. The liquid fuel oil can be a petroleum product or coal product and includes a crankcase oil, crude oil, various fuel oil such as No. 6 fuel oil, raw coal tar and any other type of combustible oil. The solid fuel which may be used can for example be coal, coke breeze, petroleum coke, asphalt, carbon black or finely ground newsprint, sawdust, and colloidal organic polymer microcrystals. The colloidal emulsifiers comprise concentrations of submicron particles such as carbon black (average particle size about 500 Angstroms) or microcrystals isolated from linear organic polymers such as polyester microcrystals (300 Angstroms), amylose starch microcrystals (200 Angstroms), and polyeuride microcrystals (300 Angstroms). The average particle size of the submicron carbon black particles suitable for use in this invention are disclosed to have an average particle size of about 500 Angstroms.

In U.S. Pat. No. 2,754,267 (1956) of A. A. Bondi entitled "Carbon Black Concentrates" and assigned to Shell Development Company, improved suspension of carbon black is disclosed. Use of finely divided carbon black for the purpose of increasing flame radiation is disclpsed to be a function of the fine carbon black size and greater surface area. This enables the production of maximum flame radiation when they are combined with fuel oil and burned. An essential component of an oil-soluble copolymeric material is required to avoid gel-like structures or the formation of grease compositions when mineral oils and carbon blacks are combined. Broadly these copolymers are prepared as hydrolized or alcoholized copolymers of straight chain alpha-olefin hydrocarbons containing from 8 to 40 carbon atoms per molecule with hydrolizable vinyl compounds involving vinyl halides and vinyl esters and comparable copolymers of the same type of straight-chain alpha-olefins with other low molecular weight polynurizable polar substitute alpha alkenes. The essentially copolymeric materials are believed to coat the carbon black particles.

U.S. Pat. No. 4,306,881 (1981) of R. S. Sterns entitled "Carbon Slurry Fuels" assigned to Suntech, Inc., discloses a liquid composition having carbon particles dispersed therein of at least two disparate particle sizes. Appropriate rheological properties in a slurry fuel composite is achieved by dispersing 40% by weight of a hydrocarbon of carbon blacks comprising particle sizes of two disparate particle sizes. One carbon particle size has an average diameter from about 70 to about 100 microns and the second particle has an average particle size of from 20 to about 50 microns. Examples of particles having an average particle size diameter from 60 to 100 microns is semi-reinforced black (SRF). A suitable particle of average particle diameter from about 20 to about 50 microns is high abrasion furnace (HAF) black. Each of these are commercially available. Liquid hydrocarbon employed involved conventional jet fuel types. Fuel compositions prepared by this disclosure are high density, high performance fuels having, for example, at least about 170,000 BTU per gallon of slurry.

U.S. Pat. No. 4,441,887 (1974) of J. E. Funk ("The Funk Patent") entitled "Stabilized Slurry and Process for Preparing Same" assigned to Alfred University Research Foundation, Inc., discloses a stable slurry containing carbonaceous solid material such as coal or coke with a defined particle size distribution (a "Funk distribution") in a liquid carrier such as water or oil containing optionally a dispersing agent. The particle size distribution required is determined so as to have a specific surfaee area from about 0.8 to about 4.0 square meters per cubic centimeter. "Specific surface area" is defined in reference to the calculated summation of the surface area of equivalent spheres in the particle size distribution as measured by sieve analysis and sedimentation techniques. One calculates the surface area based on the assumption that all particles are spherical. A specified particle size distribution in accordance with the following formula (provided in the specification) establishes optimum distribution of particle sizes to achieve a high loading coal water dispersion.

$$\frac{CPFT}{100} = \sum_{j=1}^{k} \left[ X_j \left( \frac{D^{Nj} - D_{sj}^{Nj}}{D_{Lj}^{Nj} - D_{sj}^{Nj}} \right) \right]$$

-continued $$\text{where } \sum_{j=1}^{k} X_j = 1.0$$

$$\text{and where if } D < D_{sj} \left[ \frac{D^{Nj} - D_{sj}^{Nj}}{D_{Lj}^{Nj} - D_{sj}^{Nj}} \right] = 0.0$$

$$\text{and where if } D > D_{Lj} \left[ \frac{D^{Nj} - D_{sj}^{Nj}}{D_{Lj}^{Nj} - D_{sj}^{Nj}} \right] = 1.0$$

wherein:

1. CPFT is the cumulative percent of said solid carbonaceous material finer than a certain specified particle size D, in volume percent;
2. k is the number of component distributions in the compact and is at least 1;
3. $X_j$ is the fractional amount of the component j in the compact, is less than or equal to 1.0, and the sum of all of the $X_j$'s in the consist is 1.0;
4. N is the distribution modulus of fraction j and is greater than about 0.001;
5. D is the diameter of any particle in the compact and ranges from about 0.05 to about 1180 microns;
6. $D_s$ is the diameter of the smallest particle in fraction j, as measured at 1% CPFT on a plot of CPFT versus size D, is less than $D_L$, and is great than 0.05 microns; and
7. $D_L$ is the diameter of the size modulus in fraction j, measured by sieve size or its equivalent, and is from about 15 to about 1180 microns;

At least 5% by weight of the coal particles are asserted to be of colloidal size. Colloidal size particles are defined to have one or more of its dimensions in the range of 100 Angstroms to 3 microns. Other properties of importance in the formation of the stabilized slurry are: porosity and zeta potential. In summary, the grinding process results in a coal-liquid mixture that has a high solids content in the presence of a dispersing agent wherein (1) the mixture comprises finely-divided particles of coal having specified surface area and porosity properties dispersed in a liquid; (2) a solids content, viscosity and yield stress properties within certain calculated values; (3) a particle size distribution in accordance with the specified formula set forth in the specification; and (4) solids content, porosity and specific surface area and zeta potential related in accordance with a stability formula defined in the specification.

In those cases where the properties are not in accordance with the stability formula, their stability can be increased by either (1) adding fines to the slurry in order to increase specific surface area, and/or (2) adding one or more dispersants to a slurry to affect the zeta potential, and/or (3) adding a stabilizer to the slurry to affect zeta potential and/or (4) diluting or concentrating the slurry.

It has been discovered that coal-water dispersions can be surprisingly improved in both stability and viscosity by the addition of certain carbon blacks. Effectiveness of the carbon blacks appears to be more than merely the introduction of particulates having the size of ground coal fines.

For example, during manufacturing it was found that it was possible to improve stability somewhat by increasing the weight percent of coal fines, i.e. percentage by weight of particles passing one micron. Approximately 4% by weight increase in coal fines led to a substantial improvement in stability. However it was found that by adding one tenth as much carbon black as coal fines produced slurries at least as stable and in many instances more stable.

The surface area of the carbon black on a weight basis as determined by a Leeds and Northrop Microtrac (registered trademark) was two to three times as great as that of coal fines. The improvement of stability therefore is not merely a simple function of increasing the surface area as determined by a Microtrac.

There are processing advantages to improving stability of coal water dispersion by means of carbon black addition. The energy costs for grinding coal particles needed to make a stable slurry is much greater than would otherwise be the processing cost and difficulties associated with dispersing appropriately sized carbon black.

J. E. Funk in U.S. Pat. No. 4,441,887 (1984) discloses that an improvement in stability to slurries of carbonaceous solid material may be achieved by the addition of fines. Not disclosed is the nature of these fines or that they have the properties of carbon black.

Accordingly, it is an object of this invention to provide a method and composition for making coal-water mixtures having solids loading up to 80% by weight. Another object of this invention is to utilize the unique particle size distribution found in highly structured types of carbon black to stabilize a coal-water slurry, wherein the particle size distribution of coal particles approximate within 10% that reported in the Funk Patent.

Finally, it is an object of this invention to provide a manufacturing scheme to obtain the desired particle size distribution of coal particulates especially suited for requirements of this invention.

Other objects of this invention will be clear from reading this specification.

BRIEF DESCRIPTION OF THIS INVENTION

Broadly, this invention involves a composition of matter containing, as based on the total weight of the composition, at least 15% weight, but preferably at least 20% by weight and generally 25% by weight to 35% by weight, of water and has a viscosity at 25° C. under a sheer rate of 100 reciprocal seconds ($SEC^{-1}$) no greater than 2,000 centipoise ("cp"), as measured according to a procedure developed and reported as laboratory test CS-3413 by the Electric Power Research Institute ("EPRI") in Volume 1 of a public report entitled "Coal-Water-Slurry-Evaluation."

The coal particulate size distribution appropriate to this invention closely parallels that reported in the Funk Patent with the assumption that the maximum coal particle size is 300 microns ("m") and a minimum particle size of about 0.5 m, wherein the actual cumulative percent of particles that will pass through various sized micron sizes is within 10% of the calculated value for each micron size of a Funk distribution.

Coals particulates with this distribution provide a suitable solid phase in the presence of the appropriate sized carbon black to yield stable coal-water mixtures.

Carbon black suitable for this invention has the following described characteristics. It is preferably produced in a refractory-lined furnace reactor by pyrolysis of highly aromatic refinery by-product oils. These oils are subjected to high temperatures of about 1,400° to 1,650° C. in a reaction zone maintained to conditions producing an endothermic reaction which strips aromatic hydrogen from the aromatic hydrocarbon molecules to leave aromatic nuclei. The resulting reticulated particles in the form of black "smoke" are quenched in a downstream tunnel by water injection at a point several feet from the reaction zone. In this method of manufacturing carbon black, the primary particle size can be closely controlled and produces particle diameters in the range of about 200 to 900 Angstroms. These primary particles are simultaneously bound together to form primary reticulated chains having lengths in the range of about 500 to 30,000 Angstroms.

Broadly, one embodiment of this invention involves a composition comprising about 50 to 80% by weight but preferably 65 to 80% by weight of coal particulates having a particle size distribution within 10% of the value calculated in accordance with a Funk distribution which assumes a maximum coal particle size of about 300 microns and a minimum coal particle size of about 0.5 microns; and 0.1 to 2% preferably about about 0.2 to 2% by weight, as based upon the total weight of dry coal, of carbon black having a primary carbon particle size in the range of about 200 to about 900 Angstroms which primary carbon particles are simultaneously bound together to form primary reticulated chains having lengths in the range of about 500 to 30,000 Angstroms. "Dry Coal" is intended to mean coal free from moisture as a result of conditioning and heating at suitable temperatures, as defined in ASTM D3173, entitled "Moisture in the Analysis Sample of Coal and Coke". The water content of these compositions ranges from 18 to 35% by weight.

Still more precisely, the carbon particle size is preferably in the range of about 150 to 500 Angstroms and still more preferably 300 to 400 Angstroms. The primary reticulated chains preferably have lengths in the range of about 500 to 20,000 Angstroms, and still more preferably in the range 500 to 3,000 Angstroms.

Optionally, but preferably about 0.2 to 2% by weight of a dispersant, as based on the total weight of dry coal, can be used. This facilitates use of a stirred ball mill in bringing about particle size reductions of ground coal particulates. The dispersant preferably is anionic, although non-ionic dispersants may also be used. Preferably the dispersant is one selected from the group consisting of ammonium naphthalene sulfonic acid, hexadecyltrimethylammonium bromide, and ammonium lignosulfonate.

More specifically, a preferred type carbon black suitable for this invention meets the specifics of ASTM N-219. These blacks have relatively low structure and are made using an intermediate super-abrasion furnace. Such blacks are available from Ashland Chemical (United N-219 and N-110), Cabot (Regal 600), Columbin (Neotex 130), Continental (Continex ISAF-LS), and Phillips (Philblack N-219). The average particle diameter of these blacks is about 300 Angstroms and it has an ASTM Iodine Number of about 115 (a measure of surface area per unit weight corresponding well with nitrogen absorption measurements for furnace black). The relatively low structure of these blacks is indicated by a low DBP absorption value of about 0.78 cubic centimeters per gram (the DBP absorption value is indicative of the degree of linkage between primary carbon black particles).

A measure of the stability for several compositions is reported in the following stability data table.

| CWF Sample Description | Apparent Viscosity, cp @ 100 $sec^{-1}$ | Solids | Days After Manufacture | | | | | | |
|---|---|---|---|---|---|---|---|---|---|
| | | | 1 | 3 | 7 | 15 | 21 | 28 | 44 |
| WLST, 0% Carbon Black, No Mixing | 1011 | 71.2 | 1/16* | ¾ | 1¼ | 2¼ | 2¾ | 4¼ | 4⅛ |
| WLST, 0% Carbon Black, No Mixing | 835 | 71.1 | 1/16 | ¼ | ½ | 1 | 3 | 4 | 4 |
| WLST, 0.2% Carbon Black, Mixing | 711 | 70.5 | <1/16 | 1/16 | ¼ | ⅜ | 2¼ | 4 | 3¾ |
| WLST, 0.3% Carbon Black, Mixing | 620 | 70.1 | <1/16 | 1/16 | ¼ | ¼ | ¼ | ¾ | 1 1/16 |
| WLST, 0.4% Carbon Black, Mixing | 635 | 69.8 | <1/16 | 1/16 | ¼ | ¼ | ¼ | ⅜ | 1 1/16 |
| WLST, 0.2% Carbon Black, Mixing | 827 | 71.1 | 1/16 | 1/16 | ¼ | ½ | 3¼ | 3¼ | 3¾ |
| WLST, 0.3% Carbon Black, Mixing | 1297 | 71.2 | 1/16 | 1/16 | ¼ | ¼ | ¼ | 1 | 3¾ |
| WLST, 0.4% Carbon Black, Mixing | 902 | 71.0 | — | — | — | ⅛ | ⅛ | ¼ | ½ |
| ERST, 0% Carbon Black, No Mixing | 1308 | 72.6 | <1/16 | 1/16 | ¼ | ½ | ½ | ¾ | 1¼ |
| ERST, 0% Carbon Black, Mixing | 978 | 72.5 | — | — | 1/16 | ¼ | ¼ | ¼ | ⅜ |
| ERST, 0.2% Carbon Black, Mixing | 921 | 72.4 | — | — | — | — | 1/16 | ¼ | ½ |
| ERST, 0.3% Carbon Black, Mixing | 865 | 71.9 | — | — | — | — | 1/16 | ¼ | ⅝ |
| ERST, 0.4% Carbon Black, Mixing | 959 | 71.5 | — | — | — | — | 1/16 | ⅛ | ¾ |
| ERST, 0.2% Carbon Black, Mixing | 1203 | 72.6 | — | — | — | — | — | 1/16 | ½ |
| ERST, 0.3% Carbon Black, Mixing | 1391 | 72.5 | — | — | — | — | — | ⅛ | ¼ |
| ERST, 0.4% Carbon Black, Mixing | 1241 | 72.5 | — | — | — | — | 1/16 | ⅛ | ½ |

*The measured sediment in inches. The total height of CWF sample in each container was 5".

A procedure for carrying out the milling steps that has been found suitable to this invention can involve both dry and wet milling processes. This procedure is discussed in more detail hereinafter.

PROCESS STEPS IN MAKING A SLURRY

There can be two separate series of process steps which leas to a final slurry. One series involves a dry series of process steps and the other a wet series of process steps. In the dry series of process steps, there is a ring and ball pulverizer used to produce a particulate distribution of coal in nineteen-size ranges which can be as follows:

TABLE OF SIZES AND RANGE IN PERCENT BY WEIGHT LESS THAN OR EQUAL TO EACH SUCH SIZE

| Ranges of % Passing | Size in Microns |
|---|---|
| 90–100 | 300 |
| 90–99 | 212 |
| 80–90 | 150 |
| 71–80 | 106 |
| 56–65 | 75 |
| 46–55 | 53 |
| 36–45 | 37.5 |
| 26–35 | 26.5 |
| 20–30 | 18.8 |

-continued

TABLE OF SIZES AND RANGE IN PERCENT BY WEIGHT LESS THAN OR EQUAL TO EACH SUCH SIZE

| Ranges of % Passing | Size in Microns |
|---|---|
| 12–24 | 13.9 |
| 10–20 | 9.38 |
| 5–15 | 6.63 |
| .5–10.5 | 4.69 |
| .2–5 | 3.31 |
| .5–3.5 | 2.34 |
| .2–3.2 | 1.66 |
| .5–2.5 | 1.17 |
| .1–2.5 | 0.83 |
| 0–2.0 | 0.59 |

A ring and ball pulverizer such as Model EL-35 and E-20 to E-70 are commercial pieces of equipment sold by Babcock and Wilcox any of which can be used.

The size distribution in a Model EL-35 is determined by the feed rate, classifier rottion rate and flow rate of gas circulating through the ring and ball pulverizer. The gas circulation can be in a closed loop of inert gas comprising CO and $CO_2$ with less than 8% by volume combustible oxygen.. In no event should the percent of combustible oxygen by volume be greater than 12% therein, preferable a percent by volume of 8% or less is preferred for reasons of safety.

As an example, a feed rate in the range 12,000 pounds/hour, a classifier speed in the range 140–180 rpm and a closed loop flow rated gas in the range 10–15,000 pounds/hour yields a particle sized distribution such as that disclosed above.

Cyclone separators are not recommended because they are not able to get five micron particles removed rapidly enough to be useful commercially. Further, there is a need to recirculate and heat the separated gas by combusting in the presence of, for example, natural gas and air. The temperature of the recirculated inert gas is generally in the range of 500 to about 700° F.

It is critical to make sure that the amount of water present in the pulverized coal is less than about one and a half percent by weight. The presence of water leads to a caking or agglomeration in either the pulverizer or baghouse. Of critical importance to achieving a satisfactory dispersion for some applications, separated coal must be screened, for example, through a rotex screen, to remove course coal with a forty mesh screen. No more than one percent greater than 50 mesh is desirable.

On the wet side series of process steps, very fine particles are produced and suspended in water consisting of roughly 50 percent by weight water and 50 percent by weight coal. A tumbling ball mill can be used to achieve a primary size reduction of coal so that there is nothing larger than about 300 microns ("M"). A steel ball or tumbling ball mill are examples of equipment which can be obtained commercially from Kennedy Van Saun. The product from the tumbling ball mill is transferred to a stirred ball mill where finer balls such as ones having diameters of two microns are mechanically stirred to produce a product with a mass mean particle size of less than five microns. The particle size ultimately achieved is a function of the feed rate to the stirred ball meal. Preferably the fastest rate which will result in a product having a mass mean particle size of five microns is used.

Dispersing agents, such as ammonium lignosulfonate, Georgia Pacific L-17, ammonium naphthalene sulfonic acid and Diamond Shamrock A-23 may be used in the wet grinding process. Other examples of such agents suitable for use in this invention are: Hexadecyltrimethylammonium bromide and ethoxylated alcohol sulfite sold under the brand name Triton X-100. These dispersants are used in amounts generally proportionally to the weight of dry coal, for example, a percent by weight in range of 0.2 to 2.0 percent, and more preferably, in the range of about 0.3 to 0.9 percent by weight, as based on the total weight of dry coal in the slurry composition, are suitable. Quaternary dispersants such as quaternary succinates such as aerosol, and other ethoxylated alcohol sulfates may also be used.

The appropriate times for adding dispersing agents in the wet grinding process is in part after tumble ball milling but prior to treating in a stirred ball mill. Approximately half can be introduced into the feed to the stirred ball mill and the remainder in a slurry mix tank. A slurry tank is used to mix together the material from the wet series of process steps and the dry series of process steps.

The reason a dispersant is added to the feed to the stirred ball mill is to prevent agglomeration and extremely high viscosities which otherwise arise and which would preclude proper operation of the stirred ball mill. Additional amounts higher than necessary for the operability of the stirred ball mill will lead to a higher requirement for such dispersants when it is added to the mixing tank than would otherwise be the case.

A 50/50 mix is mixed with the dry milled coal in the following way. The apparatus used to mix the two incoming streams can be a 75 horse power blade mixer. The rate of addition is 10 to 20 tons/hour. In mixing each of these components, one must be careful about the following potential problems which are:

1. The level in the mixing tank must be held constant and just above the top of the mixer blades so that the dry coal will wet properly and go into suspension; and
2. Solids concentration must be maintained within plus or minus 0.25 weight percent; and
3. Mixing rate must be sufficient to minimize the slurry viscosity, whereby a more stable slurry is generally produced.

In still more detail, a process for making slurries in accordance with this invention is described.

Coal was received, crushed and conveyed to overhead coal bunkers in the coal handling section. Coal was fed from the bunkers to either the wet side or dry side processing equipment. In the dry side the coal flowed by gravity through a bunker valve to one of three "Stock" trade name of Stock Equipment Co., Inc. gravimetric feeders. The discharge from each of the gravimetric feeders fed a B&W EL-35 ring and ball pulverizer. These pulverizers were equipped with variable speed, hydraulically driven classifiers. The pulverizers were swept with hot flue gas produced by a recirculating air heater to dry the pulverized coal sufficiently for it to be separated from the flue gas in a bag house. The cleaned flue gas from the bag house passed to the suction of the primary air fan. Some of the discharge of the primary air fan was vented to pressure balance the system. The bulk of the primary air fan discharge went to the primary air heater where it was heated from approximately 180 degrees F to approximately 650 degrees F by mixing with the combustion products of a 2.8 MM BTU/hr natural gas burner. A combustion air fan supplied air for the burner. The inlet temperature to the pulverizer was regulated by control valves on both the natural gas and combustion air. The oxygen content in the recirculating gas loop was controlled by a ratio controller for the combustion air valve. The oxygen content in the system was continuously monitored and never allowed to exceed 8% when coal was being fed to a pulverizer (most pulverized coals are not explosive below 12% oxygen).

The particle size distribution of the coal leaving the pulverizers was determined by (in order of decreasing importance) the following:

1. Raw coal feed rate
2. Raw coal Hardgrove Grindability Index
3. The flow rate of gas sweeping the mill
4. The temperature of the gas sweeping the mill
5. The rotational speed of the hydraulic classifier The pulverized coal was pneumatically transported from the mill to a bag house at the top of the building. Pulverized coal was removed from the gas stream on the outside of fabric bags. Pulsed jets of air periodically cleaned the bags. The coal collected in the bottom of the bag house container and left through a rotary valve. The coal from each bag house (if more than one pulverizer was in operation) was combined in a common duct and dropped into the coal water mixing tank. The cleaned gas from the bag house was returned to the primary air fan.

Processing on the wet side began when coal dropped from the wet side coal bunker through a knife gate valve onto an "Auto-weight" trade name of Auto-Weigh Equipment Co. gravimetric feeder where the flow rate was controlled, monitored, recorded, and totalized. The discharge of the gravimetric feeder went to a cage mill where the maximum particle size of the coal was reduced to less than ¼ inch. The cage mill product dropped into a ribbon feeder which transported the coal and makeup water into the Kennedy Van Saun tumbling ball mill. In the normal processing mode the tumbling ball mill was operated such that it produced a slurry that was roughly 50% coal and 50% water by weight. A minimum of 50% of the coal passing 200 mesh (75 microns) was required. Equipment to meter additives to the tumbling ball mill was installed but not used during normal operation.

Slurry from the tumbling ball mill was discharged into the mill product tank. The mill product pump transported the slurry to a Liquatex vibrating screen. All of the coal exceeding 30 mesh (600 microns) was rejected to the feed of the tumbling ball mill. The screened slurry flowed to the mill transfer tank. The mill transfer pump moved the slurry to the coarse grind tank. Chemical dispersant was added to the slurry as it left the coarse grind tank. It then passed through an in-line mixer before the line branched into five separate lines each of which was a suction to a variable speed feed pump for a vertical stirred ball mill. The flow to each stirred ball mill was measured by a magnetic flow meter. The flow signal went to a flow controller which automatically adjusted the feed pump speed to maintain the selected flow rate. The mass mean particle size of the stirred ball mill product was typically 5 microns. The feed rate to the mills were adjusted to maintain the desired particle size distribution.

The discharge of all five stirred ball mills was collected in the stirred ball mill product tank. The stirred ball mill product pump moved the slurry through a magnetic flow meter to the coal water mixing tank for final product mixing.

In the slurry mixing section the product of the wet and dry side sections were combined in the coal water mixing tank. Additives such as dispersants, wetting agents, ammonia, and stabilizers could be added during mixing. The level in the coal water mixing tank was held constant to facilitate mixing. Dilution water was added to bring the slurry to the desired solids content. The product slurry was pumped from the coal water mixing tank to the local tank farm by a coal water product pump. An in-line nuclear density analyzer was used to determine the solids content on-line. Regular laboratory analyses of periodic samples were used to correlate the density reading to solids content. The pH and temperature were also measured in line at this point.

The product from the coal water mixing tank could be sent to either of two dilution tanks or directly to either of two local storage tanks. The dilution tanks were used for final quality control adjustments. From the dilution tanks the slurry was pumped to one of the local storage tanks by the local storage pump. From the local storage tanks slurry could be directly loaded into rail cars or tank trailers or it could be transferred to one of three remote storage tanks. From the remote storage tanks the slurry could be loaded into either rail cars or tank trailers. All slurry storage tanks were agitated and insulated, the local storage tanks and the dilution tanks were also steam heated to prevent freezing during winter months.

The plant utility section included a plant air compressor, a cooling water circulation system, a dilution water circulation system, an electrical distribution system, and a system drain.

Specific compositions, methods, or embodiments, discussed are intended to be only illustrative of the invention disclosed by this Specification. Variations on these compositions, methods, or embodiments are readily apparent to a person of skill in the art based upon the teachings of this Specification and are therefore intended to be included as part of the inventions disclosed herein. For example, an alternate processing scheme which can also be used to prepare slurries within the scope of this invention involves using only wet processing steps. The tumbling ball mill alone can be used to bring about appropriate size reduction. In this scheme crushed coal (less than 3/4") is fed with water, carbon black, and a dispersant, for example aqua ammonia to the tumbling ball mill in amounts required to produce the previous described slurry composition. The product from the tumbling ball mill process is passed through a 16 to 50 mesh screen where oversized material is returned as part of the feed to the tumbling ball mill. The screened product which passes through the mesh screen is transferred to a mixing tank where additional mixing is done to improve slurry viscosity. Adjustments to the composition can be made in the mixing tank. The material leaving the mixing tank is the final product.

Compositions involving percent by weight ranges are intended to include the appropriate selection of values for each weight percent so that the total weight percent of all components equals 100%. Reference to patents made in this Specification is intended to result in such patents being expressly incorporated herein by reference including any patents or other literature references cited within such patents.

What is claimed is:

1. A composition comprising:

about 65 to 80% by weight of coal particulates with a particle size distribution within 10% of the value calculated in accordance with a Funk distribution which assumes a maximum coal particle size of about 300 microns and a minimum coal particles size of about 0.5 microns;

about 0.1 to 2% by weight, as based upon the total weight of dry coal, of carbon black having a primary carbon particle size in the range about 200 to about 900 Angstroms which primary carbon particles are simultaneously bound toghether to form primary reticulated chains having lengths in the range of about 500 to 30,000 Angstroms, and a carrier liquid selected from the group consisting of water and oil.

2. Composition of claim 1, wherein there is additionally about 0.2 to 2% by weight of a dispersant as based on the total weight of the dry coal.

3. The composition of claim 2, wherein said dispersant is an anionic dispersant.

4. Composition of claim 2, wherein said dispersant is selected from the group consisting of ammonium naphthalene sulfonic acid, hexadecyltrimethylammonium bromide, and ammonium lignosulfonate.

5. Composition of claim 1, wherein said primary carbon particle size of said carbon black is in the range of about 150 to 500 Angstroms and said primary reticulated chains of said primary carbon particles having lengths in the range of about 500 to 3,000 Angstroms.

6. Composition of claim 1, wherein said primary carbon particle size is in the range of about 300 to 400 Angstroms and said primary reticulated chains of said carbon particles have lengths in the range of about 500 to 20,000 Angstroms.

7. Composition of claim 1, wherein said primary carbon black particle size is in the range of about 300 to400 Angstroms said primary reticulate chains of said carbon particles are in the range of about 500 to 3,000 Angstroms.

8. The composition of claim 2, wherein said dispersant is present in a percent by weight in the range of about 0.3 to 0.9.

9. The composition of claim 4, wherein said dispersant is present in a percent by weight in the range of about 0.3 to 0.9.

10. The composition of claim 5, wherein said dispersant is present in a percent by weight in the range of about 0.3 to 0.9.

11. The composition of claim 6, wherein said dispersant is present in a percent by weight in the range of about 0.3 to 0.9.

12. The composition of claim 7, wherein said dispersant is present in a percent by weight in the range of about 0.3 to 0.9.

13. A composition comprising:

about 65 to 80% by weight of coal particulates with a particle size distribution within 10% of the value calculated in accordance with a Funk distribution which assumes a maximum coal particle size of about 300 microns and minimum coal particle size of about 0.5 microns;

about 0.2 to 2% by weight, as based upon the total weight of dry coal, of carbon black having a primary carbon particle size in the range of about 200 to about 900 Angstroms which primary carbon particles are simultaneously bound together to form primary reticulated chains having lengths in the range of about 500 to 30,000 Angstrons;

a carrier liquid comprising 20 to 35 wt. % water; and from 0.2 to 2.0 wt. % of a dispersant selected from the group consisting of ammonium naphthalene sulfonic acid, hexadecyltrimethylammonium bromide, and ammonium lignosulfonate.

* * * * *